US008449402B2

(12) United States Patent
Jaekel et al.

(10) Patent No.: US 8,449,402 B2
(45) Date of Patent: May 28, 2013

(54) DEVICE AND METHOD FOR MONITORING THE STRIKING ACCURACY AND THE SWING MOVEMENT OF A GOLF CLUB

(75) Inventors: Richard Jaekel, Frankfurt am Main (DE); Arnold Herp, Möhrendorf (DE)

(73) Assignee: Richard Jaekel, Frankfurt am Main (DE)

( * ) Notice: Subject to any disclaimer, the term of this patent is extended or adjusted under 35 U.S.C. 154(b) by 0 days.

(21) Appl. No.: 12/933,974

(22) PCT Filed: Mar. 22, 2008

(86) PCT No.: PCT/EP2008/002319
§ 371 (c)(1),
(2), (4) Date: Dec. 20, 2010

(87) PCT Pub. No.: WO2009/118019
PCT Pub. Date: Oct. 1, 2009

(65) Prior Publication Data

US 2011/0086720 A1 Apr. 14, 2011

(51) Int. Cl.
*A63B 57/00* (2006.01)
*A63B 69/36* (2006.01)

(52) U.S. Cl.
CPC ..... *A63B 69/3617* (2013.01); *A63B 69/3632* (2013.01)
USPC ..... 473/223

(58) Field of Classification Search
USPC ..... 473/131, 136, 223, 233; 434/242; 463/1, 463/47, 48
See application file for complete search history.

(56) References Cited

U.S. PATENT DOCUMENTS 4,898,389 A * 2/1990 Plutt ..... 473/223
4,991,850 A 2/1991 Wilhelm (Continued)

FOREIGN PATENT DOCUMENTS

GB 2 293 326 3/1996

OTHER PUBLICATIONS

International Search Report for PCT/EP2008/002319.
Alan Electronics GmbH, 63303 Dreieich, DiXX Digital Instruction Putter, www.dixxgolf.de.
Epson XV-3500 CB, Ultra Minature Size Vibration Gyro Sensor, www.epsontoyocom.co.jp.

(Continued)

*Primary Examiner* — David L Lewis
*Assistant Examiner* — Robert Mosser
(74) *Attorney, Agent, or Firm* — Stites & Harbison PLLC; Marvin Petry

(57) ABSTRACT

The device is used for monitoring the drive movement and the accuracy with which the striking surface (16) of a golf club hits a golf ball. It comprises a plate-shaped sensor (18), which can be fastened to the striking surface (16) and by which the point of impact can be located. The sensor (18) is connected by way of signal lines (26) to a measurement and computation circuit (30), which can be detachably fastened to the shaft (12) or the back of the head of the golf club, and which together with a yaw rate sensor (65) and an electrical voltage source is mounted in a housing (28) and during each strike carries out a measurement operation in order to determine coordinates of the point of impact relative to the position of a predetermined reference point (22). A radio module (34) connected to the measurement and computation circuit (30) transmits the measurement results of both sensors (18, 65) to an evaluation unit (36) in the form of a mobile phone or the like for the program-controlled evaluation and display of the measurement results on the screen (40) thereof.

12 Claims, 3 Drawing Sheets

U.S. PATENT DOCUMENTS

Figure 1:
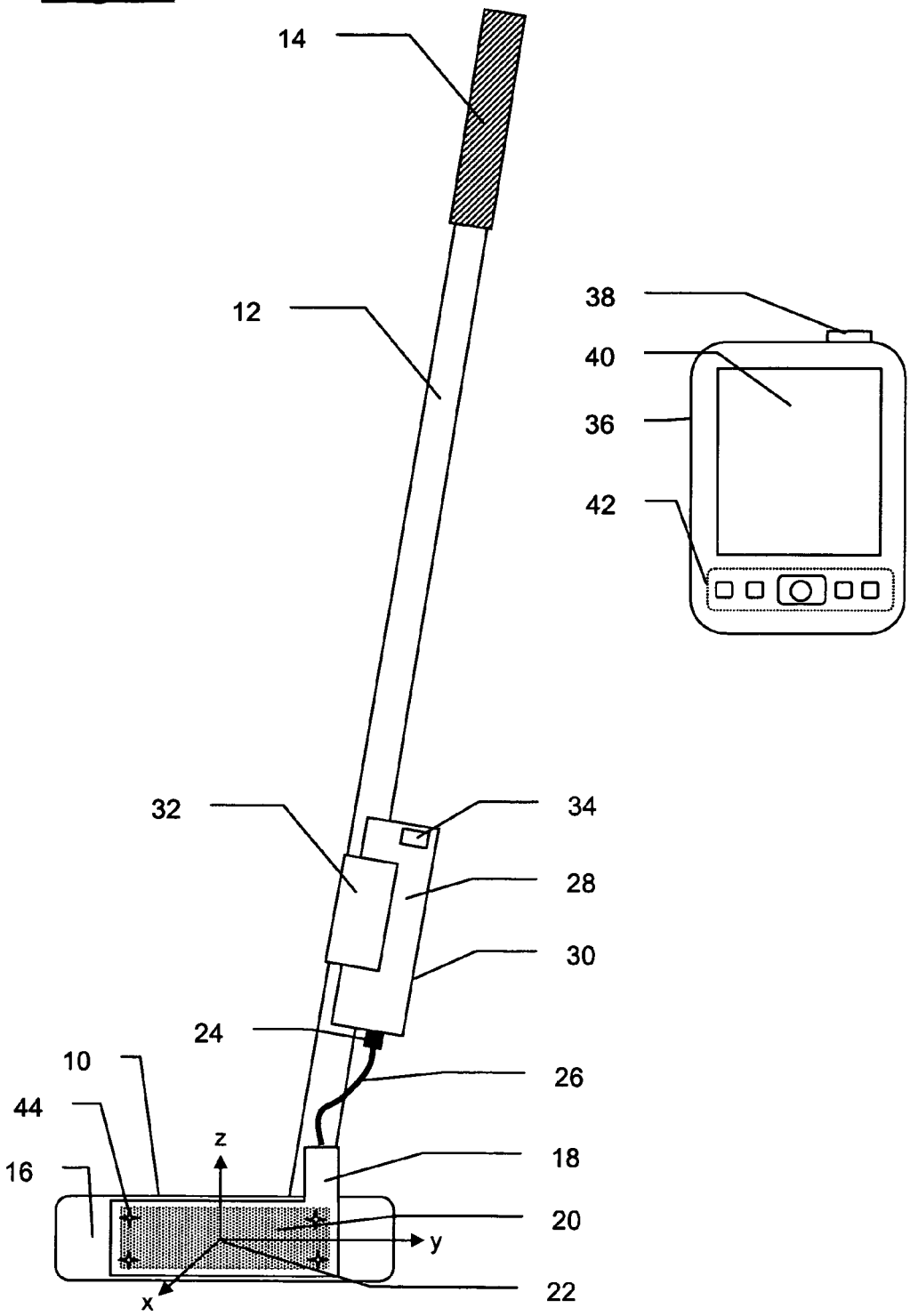

| | | | | |
|---|---|---|---|---|
| 5,419,549 | A * | 5/1995 | Galloway et al. | 473/431 |
| 6,239,790 | B1 | 5/2001 | Martinelli et al. | |
| 6,248,021 | B1 * | 6/2001 | Ognjanovic | 473/131 |
| 7,736,242 | B2 | 6/2010 | Stites et al. | |
| 2005/0215340 | A1 * | 9/2005 | Stites et al. | 473/233 |
| 2006/0084516 | A1 | 4/2006 | Eyestone et al. | |
| 2010/0216563 | A1 | 8/2010 | Stites et al. | |
| 2010/0216564 | A1 | 8/2010 | Stites et al. | |
| 2010/0216565 | A1 | 8/2010 | Stites et al. | |

OTHER PUBLICATIONS

Murata, Piezoelectric Vibrating Gyroscopes (GYROSTAR), http://www.murata.com/products/catalog/pdf/s42e.pdf.

Invensense, Integrated Dual-Axis Gyro, IDG-300, www.invensense.com.

Analog Devices, Single Chip Yaw Rate Gyro with Signal Conditioning ADXRS300, www.analog.com.

* cited by examiner

DEVICE AND METHOD FOR MONITORING THE STRIKING ACCURACY AND THE SWING MOVEMENT OF A GOLF CLUB

The invention relates to a device and a method for monitoring the accuracy with which a golf club is guided during the swing and strikes a golf ball with the striking face of the head of the golf club.

In putting in particular it is important that the putter used for this is accurately guided, so that it strikes the golf ball with the ideal spot on the striking face, the so-called sweet spot, taking into consideration the center of gravity. The situation is similar in chipping and pitching.

Normally, it is only possible to detect from the result of a multitude of putts, whether a golfer has mastered the putting techniques and regularly strikes the sweet spot. Occasionally a camera is used as an aid in order to optimize the sequence of movements, but taking pictures and evaluating the film is time-consuming and entails great costs, so that this can only be considered to be a temporary step. Prior to each putt it is also possible to apply a foil, which becomes discolored under pressure, to the face of the putter, and thereafter to evaluate the sequence of foils. This method is also much too cumbersome for being practiced over an extended period of time.

Finally, a golf club is sold by Alan Electronics GmbH, 63303 Dreieich, internet address www.dixxgolf.de, designated "DiXX Digital Instruction Putter", which offers the possibility of selectively fastening a housing on the back of the club head, which contains acceleration sensors, an electronic measuring and evaluation device and a flat image screen, or a weight, which is as heavy as this unit, in an exchangeable manner. The acceleration sensors are in a position to detect several parameters of the movement of the golf club in the course of a club swing, inter alia also the position of the impact point on the one or the other side of the sweet spot. However, a determination of the actual point on the location of the striking face with which the ball was struck is not possible with such a measuring method.

It is therefore the object of the invention to provide a device of the type mentioned at the outset, which can be attached to a customary golf club without substantially changing its properties, does not require other interfering actions during play only for purposes of measurement, registers the impact point on the golf ball and the swing motion of the club head more exactly than up to now, and represents the recorded measurement results, which have been evaluated in accordance with the program, in a form in which they are available at any time.

The above object is attained by the invention by means of a device consisting of

- a plate-shaped sensor, which can be releasably fastened on the striking face in a defined position, by means of which the exact point of the position of the impact point in the course of striking a golf ball can be localized,
- an electronic measuring and computing circuit, which is mounted together with an electrical voltage source in a housing that can be releasably fastened in a defined position on the shaft or on the back of the head of the golf club, and which circuit cooperates with the plate-shaped sensor via signal lines, by means of which circuit a measuring process for determining the coordinates of the impact point in relation to the position of a predetermined reference point can be performed in the course of each impact on a golf ball,
- a rotation rate sensor, mounted in the housing, the sensitive axis of which sensor extends essentially parallel to the lower edge of the striking face, which sensor cooperates with the measuring and computing circuit for determining the direction of rotation, speed, and duration of the phases of the backswing and forward swing motions of the club head, and
- a radio module, connected with the measuring and computing circuit, for the wireless transmission of the results of the measurements to an evaluation device in the manner of a cell phone, smart phone or PDA for the program-controlled evaluation and display of the results of the measurements on its display screen.

The plate-shaped sensor is so light and thin that it can practically not be felt when a stroke is performed. Because of the application to the striking face of the golf club, and not to its back, each impact point is being registered very precisely. The measuring and computing circuit, which can preferably be fastened to the shaft of the golf club, increases its weight only minimally, because it needs to perform only the functions required for controlling the measuring processes and for determining the coordinates of the impact point and to transmit the results of the measurements by radio to a cell phone or smart phone, for example. They can be stored there and evaluated by means of suitable programs. In most cases, a cell phone, smart phone or the like, is available anyway and is regularly taken to the golf course. Suitable programs for evaluating the results of the measurements can be made available via the internet for downloading to the cell phone or smart phone. Directly following a stroke it is thus possible to read off the display of the cell phone which point on the striking face had connected with the ball. Then the player can already attempt in the course of the next stroke to correct a possible error in holding and guiding the club. Furthermore, he can pick up the cell phone at any time, for example during train travel or in a restaurant, and, alone or together with other golfers, can examine the accurate hits collected over an extended period of time, evaluated and represented in graphs, for example, compare them with other players and discuss them.

The rotation rate sensor, provided according to the invention in addition to the plate-shaped sensor, in cooperation with the electronic measuring and computing circuit registers the direction of rotation, angular speed, angular position and duration of the phases of the backswing and forward swing motions of the club head. The measurement results thereby attained can be utilized in such a way that the plate-shaped sensor is activated only once the measured values of the rotation rate sensor, until just before a strike at a golf ball, are within a certain frame and thereby signal the course of a normal backswing and forward swing motion of the club head. The rotation rate sensor thus aids in preventing accidental strikes against other objects or practice swings before a strike from entering into the statistical and graphical evaluation of the strikes that are guided in a concentrated way. Moreover, the rotation rate sensor, in conjunction with programs for evaluating its measurement results, offers the capability of gaining important indications of mistakes in guiding the golf club during the swing motion, indications that are obtained from the ratio of the duration of the backswing to the duration of the forward swing and from the angular positions of the golf club at the end of the backswing, upon striking the ball, and at the end of the forward swing. By multiplying the angular speed by the radius in question in an individual case, the speed of the club head on striking the golf ball can also be determined. Finally, in the cooperation of the rotation rate sensor, also called a gyro, with the plate-shaped sensor, the fact that while the putter has struck the golf ball with the striking face, it has done so at a point outside the plate-shaped sensor, can be ascertained and displayed.

The plate-shaped sensor is preferably constructed in the manner of a computer touchpad, with a rectangular support plate having a first layer which is electrically conductive, is applied to its front, and is connected along two oppositely located edge areas with respective printed strip conductors, which are connected to a signal line, and with a flexible protective plate, to whose back a second electrically conductive layer has been applied and which is connected along two oppositely located edge areas with respective printed strip conductors, which are connected to a signal line and extend transversely in respect to the strip conductors connected with the first conductive layer, wherein the conductive layers are separated by means of elastic spacers, whose restoring force has been selected in such a way that there is a temporary contact between the conductive layers only when a golf ball strikes an impact point.

Such a touchpad has been described in U.S. Pat. No. 6,239,790 B1, for example, to which, for the sake of simplicity, reference is made regarding the explanation of the functioning of the above characterized sensor. However, it should be noted here that a computer touchpad, for example on a laptop, is intended to be fixedly mounted in the housing of the computer and is touched by fingers relatively lightly and slowly. In contrast thereto, the sensor of the measuring device in accordance with the invention is mechanically stressed to a much greater degree when striking a hard golf ball. Moreover, other demands are made on the sensor because, in contrast to a computer touchpad, it is intended to be easily releasable from the support surface.

It has been surprisingly shown that, in spite of the greater, shock-like stress in comparison to a touchpad, when the same materials are used, the solution of problems resulting from other causes does not lie in a thicker or stronger design of the sensor, but just the opposite, in a reduction of the plate thickness. While in a touchpad of the type mentioned, the support plate normally has a thickness of approximately 1.6 mm, the support plate of the novel sensor can be about half as thick, because it is supported over the entire surface on the striking face of the golf club, so that a greater thickness is not required.

Simultaneously with the reduction of the thickness of the support plate, the advantage is attained that it, and with it the plate-shaped sensor, becomes more flexible, so that it can be more easily removed if it is fixed on the striking face of the golf club by means of a foil, which is adhesive on both sides.

A further difference between the sensor of the proposed measuring device and a computer touchpad consists in that the support plate of the touchpad is provided with strip conductors on its back or underside, and supports electronic components. In contrast thereto, the sensor electronics of the proposed sensor are located in the housing of the measuring and computing circuit, which is preferably attached to the shaft of the golf club. The thinner support plate and the transfer of the sensor electronics to the club shaft have the further advantageous result that the entire plate-shaped sensor only needs to have a thickness of approximately 1 to 2 mm, so that therefore the striking face of the golf club is only minimally moved forward.

More than a computer touchpad, the sensor of the novel device is exposed to changing temperatures and to moisture. It is therefore useful that the protective plate is solidly and sealingly connected in a material-to-material manner in the edge area with the support plate, for example glued together with it, except for an air inlet and outlet opening. The air inlet and outlet opening can be covered by means of a water-tight, but air-permeable foil, or sealed by a cover, such as in a labyrinth seal, for example, in such a way that the sensor is at least protected against dust and splashed water in accordance with IP54.

Tests have shown that the active sensor surface only needs to be approximately 45 to 55 mm wide, and for putters approximately 16 to 20 mm, for clubs for pitching and chipping 20 to 30 mm high. The sensor can be mounted such that its center point is made to coincide with the sweet spot, which is preferably located in the center of the striking face.

It furthermore appears to be useful that the signal lines have a disconnectable plug connection between the sensor and the measuring and computing circuit. This permits the separate application and replacement of the respective two units on the golf club. Preferably, the one half of the plug is fixedly attached to the housing of the measuring and computing circuit or fixed on the housing, while the other half of the plug is located at the free end of a cable. A multitude of embodiment variations are available for fastening this housing on the shaft of the golf club. It may already be sufficient to fix the housing in a frictionally connected manner by means of at least one clamp or one clamping strap, wherein a rubber-like contact face or intermediate layer is advantageous.

The device in accordance with the invention advantageously can be utilized when a golfer is experimenting with additional weights to be mounted in the hollow shaft of the golf club in order to find out with which additional weight and in which position of the weight in the shaft the best hit results can be achieved.

Figure 2:
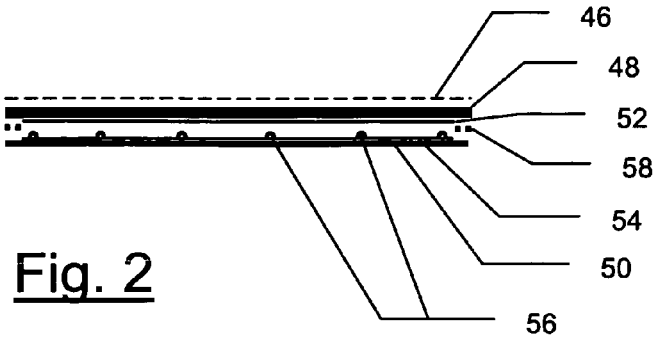
Figure 3:
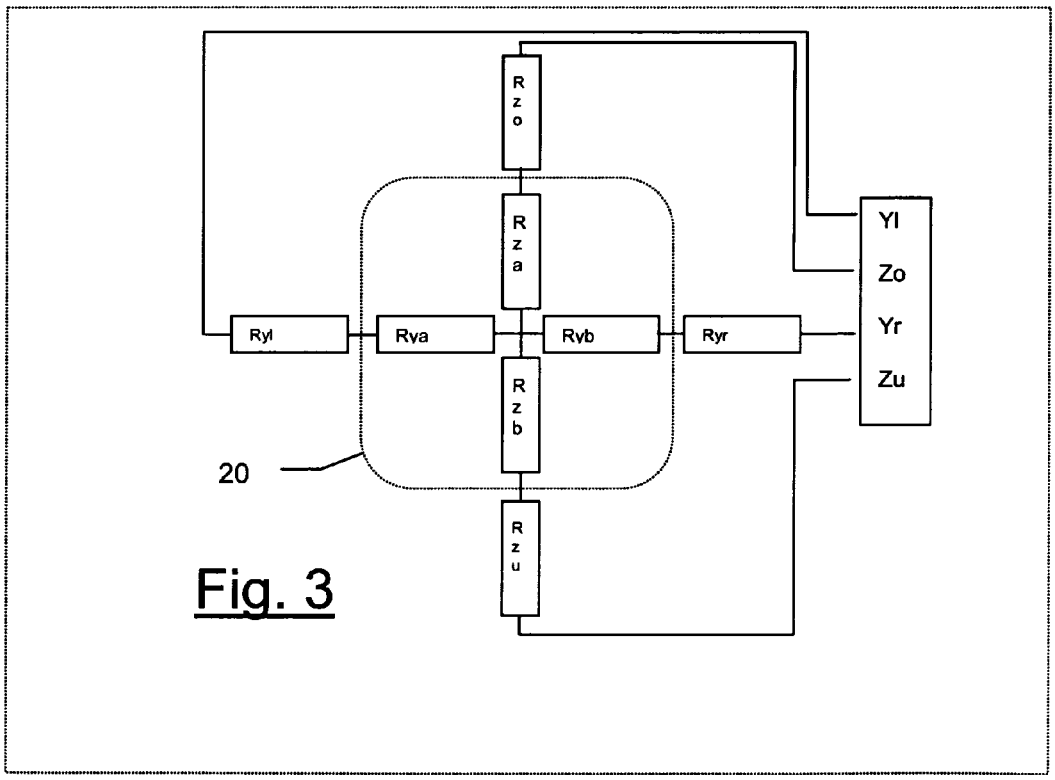
Figure 4:
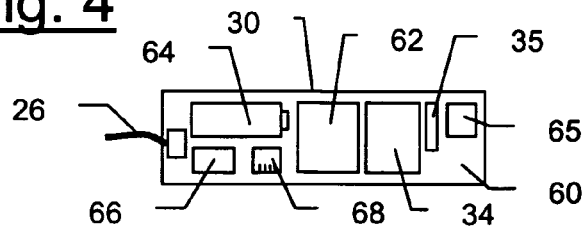
Figure 5:
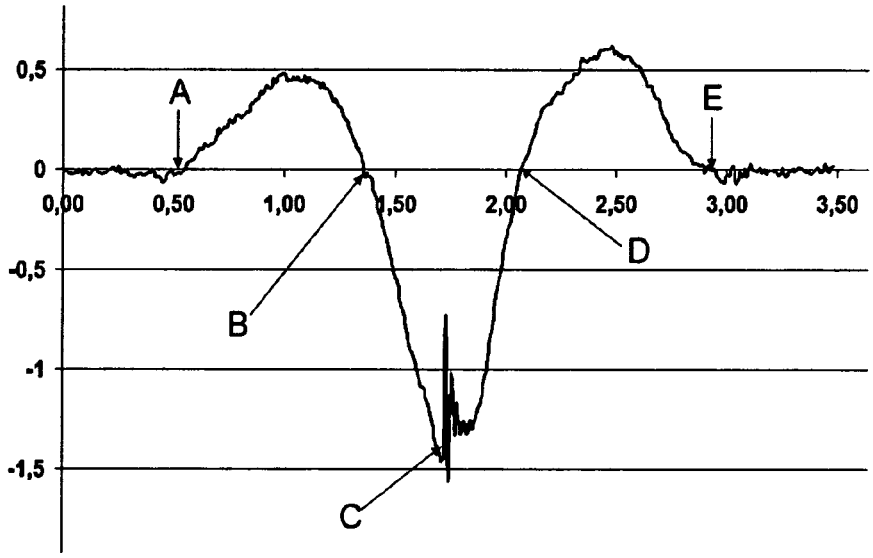
Figure 6:
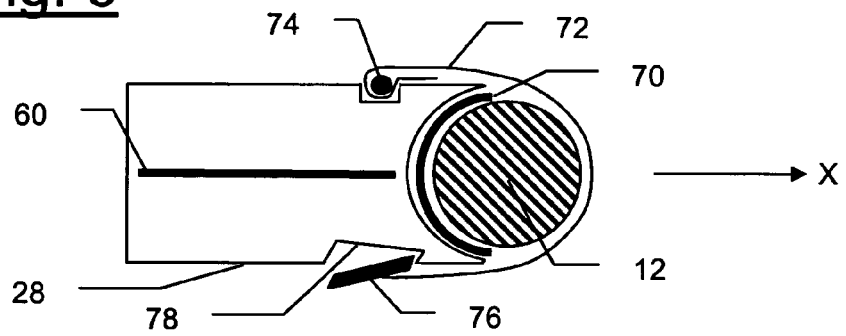

An exemplary embodiment of the invention will be described in greater detail in what follows by means of the drawings. Shown are in:

FIG. 1, a schematic representation of the total configuration of the proposed device, FIG. 2, a simplified cross section through a plate-shaped sensor, FIG. 3, a replacement circuit diagram of the plate-shaped sensor, FIG. 4, the essential elements of the sensor electronics attached to the club shaft, FIG. 5, a characteristic curve of the angular speed of the club head during putting, plotted over time and ascertained by the rotation rate sensor;

FIG. 6, a simplified cross section of the housing of the sensor electronics and the club shaft at an attachment location.

A golf club is represented in FIG. 1, whose club head is identified by 10, the shaft by 12 and the grip by 14. A sensor 18, which will be explained in greater detail in what follows, is fastened on the striking face 16 of the club head, and its actively sensitive surface is identified by 20. Here, the directions of the subsequently employed coordinates x, y and z have also been drawn in. Their common point of origin is located in the sweet spot 22 of the striking face 16.

The sensor 18 is connected via a plug connection 24 and signal lines 26, combined to form a cable, with sensor electronics, identified as a whole by 30, having a measuring and computing circuit and being mounted in a protective housing 28, which is attached to the shaft 12 by means of an easily releasable fastening mechanism 32, and is in contact via a radio module 34, preferably Bluetooth, with a mobile evaluating device 36 in the manner of a cell phone, smart phone or PDA, whose corresponding radio module is identified by 38, a flat display screen with 40 and a keyboard by 42. If desired, a laptop can also be employed as the evaluating device 36.

The y- and z-coordinates of the impact points of a golf ball in relation to the sweet spot 22, determined by the measuring and computing circuit 30 and registered accurately to a point by the sensor, together with the coordinates of the impact points of further ball strikes, are evaluated in the evaluating device 36 under program control and are graphically displayed.

The sensor 18 is of the structure represented in FIG. 2. It consists of a support plate 48, which can be fastened by means of a foil 46, adhesive on both sides, on the striking face 16, as well as a protective plate 50, arranged on the outside in front of the support plate 48. For example, the support plate 48 can be made of fiberglass-reinforced epoxy resin (preferably FR4 or FR5). The protective plate 50 can be made of a plastic material (preferably polyester). Foils, commercially available under the marks Tesa, Herma or Scotch, can be considered for the foil 46 with adhesive on both sides, in which case the adhesive force is preferably slightly greater on the side connected with the support plate 48 than on the side to be connected with the striking face 16.

On their facing insides, the support plate 48 and the protective plate 50 are each provided with an electrically conductive layer 52 or 54. These can be semiconductor layers in accordance with U.S. Pat. No. 6,239,790 B1, which have a defined linear resistance. Spacers 56 of sufficient size and sufficiently distributed are arranged between the two electrically conductive layers 52 and 54, which see to it that the conductive layers 52, 54 only touch each other if a sufficient pressure is regionally, or at points, exerted on the flexible protective plate 50, for example when struck by a golf ball. As indicated at 58, the protective plate 50 is fixedly glued together with the support plate 48 along the edge areas, but wherein at least one air inlet and outlet opening, not represented, remains open and is designed in the manner of a labyrinth seal, so that the sensor is protected against dust and splashed water in accordance with IP54.

Also not represented are two printed strip conductors, which extend along oppositely located edge areas of the support plate 48 and are electrically connected over their length with the conductive layer 52. On its interior, the support plate 48 is provided with two further printed strip conductors, which extend along oppositely located edge areas at right angles in respect to the first mentioned strip conductors and which, in the assembled state, contact the electrically conductive layer 54 on the protective plate 50 over their length. Alternatively, the strip conductors which are electrically connected with the conductive layer 54 can also be printed on the protective plate 50. Each one of the four strip conductors is connected with the measuring and computing circuit 30 via a signal line, which continues in the cable 26.

If the flexible protective plate 50 is sufficiently far indented at one location, so that the conductive layer 54 touches the other conductive layer 52 on the support plate 48, it is possible, following the application of a defined reference voltage to the strip conductors connected to one of the two layers, to measure a voltage between the strip conductors connected with the respective other layer, which rises or falls, proportionally to a change in the distance of the impact point from the strip conductors charged with the reference voltage, so that, following a calibration, it is also possible to also determine the x- and y-coordinates.

In connection with the computer touchpad of U.S. Pat. No. 6,239,790 B1, the distances of a pressure point from the strip conductors, which are arranged at right angles in respect to each other, are calculated on the basis of the length of time required by the current for charging defined capacitors connected to the strip conductors. An increased path of the current through one of the conductive layers is equivalent to an increased resistance, i.e. a reduced current strength, and therefore a longer period of time needed for charging the respective capacitor.

In contrast thereto, for working with the novel sensor a different, more rapid measuring method is provided because of the shock-like loads that have a pulse duration of 700 to 1200 μs. For this purpose, reference is made to the replacement circuit diagram in FIG. 3, in which the strip conductors identified by Yl and Yr are arranged for example at the left and right edge of the conductive layer 52, respectively; the strip conductors identified by Zo and Zu are arranged at the upper and lower edges of the conductive layer 54, respectively; the fixed resistors assigned to the respective strip conductors are identified by Ryr, Ryl, Rzo and Rzu, and the resistors in the kΩ-range of the conductive layer 52 and the layer 54, respectively, between the impact point and the four strip conductors, are identified by Rya, Ryb, as well as Rza and Rzb.

Without contact between the two layers 52, 54 at the impact point, the resistance between a strip conductor of the layer 52 and a strip conductor of the layer 54 is infinite because of the spacers 56. If a sufficiently large pressure is exerted on the protective plate 50 at a point, the two layers 52, 54 constitute the resistance network represented in FIG. 3. For the determination of the coordinates of the impact point of a golf ball, a defined reference voltage Vref is alternatingly applied during the strike between Yl and Yr, as well as between Zo and Zu, and the voltage drop is simultaneously measured with high-impedance at one end of the other layer. As can be seen, the measured voltages between Zu and Yr $Vz=Vref\times(Rzb+Rzu)/(Rzo+Rza+Rzb+Rzu)$ and between Yl and Zo, respectively $Vy=Vref\times(Rya+Ryl)/(Ryl+Rya+Ryb+Ryr)$ are proportional to the position of the impact point in the Z- and Y-directions on the sensor face. By measuring the voltages in case of pressure on, for example four, registration markers 44, arranged symmetrically around the zero point 22 of the coordinate system, which have been imprinted on the support plate 50 at defined spacings in the area of the active sensor face, it is possible to determine the relationship between voltage and spacing, and the sensor can be calibrated in this way, so that from the voltage values a conversion into mm of the position relative to the zero point 22 of the coordinate system placed on the sweet spot is possible.

The measurements are continuously performed at a suitable scanning frequency between 1 kH and 10 kH, expediently at 4 to 8 KHz, and at present preferably at 6 kH, in order to be able to definitely determine the position of an impact point in both coordinate directions during the length of the pressure. Furthermore, the time of the striking of the golf ball and the length of pressure can be determined in that valid measurement values can be differentiated from 0 Volt by means of the constant end resistors Ryl, Ryr, Rzo and Rzu. For the z-axis, the voltages which can be measured when pressure is exerted are between $Vref\times(Rzo+Rza+Rzb)/(Rzo+Rza+Rzb+Rzu)$ Volt, and $Vref\times Rzu/(Rzo+Rza+Rzb+Rzu)$ Volt, and for the y-axis between $Vref\times(Ryl+Rya+Ryb)/(Ryl+Rya+Ryb+Ryr)$ Volt, and $Vref\times Ryr/(Ryl+Rya+Ryb+Ryr)$ Volt. Scanning is performed at 8 bit to 12 bit, preferably at 10 bit.

In FIG. 4, the essential parts of the measuring and computing circuit 30 are represented. They are attached to a board 60 in the housing 28 and are interconnected in the customary manner.

Most important is a micro-computer, identified by 62, having RAM, a FLASH memory, A/D converters, inputs and outputs (GPIOs) and a serial interface, preferably UART and SPI. The micro-computer 62 controls the application of the reference voltage to the signal lines, which are connected with the electrically conductive layers 52, 54, registers the voltages measured in the course of the measuring process and the associated times, and calculates the coordinates of the impact points. These are intermediately stored and are passed on to the evaluating device 36 via the radio module 34 with an aerial, preferably a ceramic aerial 35. A battery 64 is used for the electrical current supply, whose charging regulator is represented at 66. Charging takes place through a jack 68, preferably an USB jack of the type Mini-B, or a 2.5 mm jack bush. The micro-computer 62 can also be reprogrammed via this jack.

The measuring and computing circuit 30 also includes a rotation rate sensor (gyroscope or gyro) 65, which is mounted in the housing 28 in such a way that its sensitive axis extends essentially parallel to the striking face 16 and the lower edge thereof, or in other words perpendicular to the plane of the swing motion of the reference point 22 in putting. Suitable rotation rate sensors 65 are available on the market, for instance under the trade names of Epson XV-3500 TB, Murata Gyrostar, InvenSense IDG-300, and Analog Devices ADXRS 300. In cooperation with the microcomputer 62, the rotation rate sensor 65 ascertains a number of measurement values, for instance 100 of them per second, for the angular speed of the club head 16 during its back-and-forth swing motion during putting, and these values, plotted over the period of approximately 3 seconds, produce a characteristic curve similar to that shown in the graph in FIG. 5. In it, the repose or outset position is shown at A. From there on, the angular speed initially increases in the backward direction, then decreases, until at B the end of the backswing is reached, in the rearmost position of the club head. There, the angular speed in the striking direction is zero, and the forward motion begins. It becomes faster until the golf ball is struck at C, then becomes increasingly slower, until at D the end of the forward swing is reached, in the forwardmost position of the club head. An initially accelerated, then lagging, backward motion then ensues, until the club head returns to the outset position again at E.

The acceleration can be derived from the course of the characteristic curve of the angular speed in FIG. 5. By integration, the angle traversed is obtained, and in this way it is possible to determine the positions of the putter at the end of the backswing and of the forward swing, and the vertical position of the striking face when it strikes the ball can be controlled. Multiplying the angular speed by a radius that is dependent on the body size yields the speed of the club head during the individual phases of the put and at the moment the ball is struck. Moreover, the characteristic curve furnishes the precise duration of the backswing and of the forward swing until the ball is struck. Golfers pay particular attention to the quotient of these time periods and to the form of the characteristic curve at the transition from the backswing to the forward swing, which can for example reveal an uncertainty that is expressed by hesitation.

Especially advantageously, the measurement signals of the rotation rate sensor 65 can be utilized to control the function of the plate-shaped sensor 18. Specifically, this sensor does not need to be activated by the microprocessor 62 until the measurement results of the rotation rate sensor 62 are within certain limit values and thereby display the fact that a putt has been begun with an acceptable backswing and an acceptable onset of the forward swing. By not activating the plate-shaped sensor 18 until during the forward swing, immediately before the ball is struck and after prior checking of the initial course of motion, it is attained that not every impact of the striking face against a hard object, nor a slow practice swing, will enter into the evaluation of the putts that are done with concentration.

Further advantages are offered by the use of a two- or three-axis rotation rate sensor 65, which besides the sensitive axis parallel to the y-axis shown in FIG. 1 has at least one further sensitive axis parallel to the x-axis and/or to the z-axis. Alternatively, three separate rotation rate sensors could be used, each for one of these axes. In this way, beginning each time at the outset position A of the golf club before the beginning of the backswing, the rotation rates can be measured, for instance about all three axes, and the angular position of the striking face can be determined.

The angular speeds ascertained by the microcomputer 62 from the measurement signals of the rotation rate sensor 65, as well as the coordinates of the impact points ascertained from the measurement signals of the plate-shaped sensor 18, are transmitted via the radio connection 34, 35, 38 to the evaluating device 36 and are evaluated and displayed there in accordance with the program.

A quick-fastening mechanism for the releasable fastening of the housing 28 of the measuring and computing circuit 30 on the shaft 12 of the golf club is represented in FIG. 6 which, in accordance with FIG. 1, is preferably located on the side of the shaft 12 opposite the club head 10, or on the side opposite the striking face 16. As represented, on the side resting against the shaft 12 the housing 28 is cut out in a channel-like manner with a diameter slightly larger than the shaft diameter. A rubber insert 70 has been placed between the housing 28 and the shaft 12, which can also be glued to the housing 28 and can aid in protecting the housing against dust and splashing water in accordance with IP54. The connection of the housing with the shaft 12 takes place by means of a flexible plastic shackle or a clamping strip 72, for example a textile strip, each of which can be rubberized on the inside. The one end of the clamping strip 72 is fixed on a deflection pin 74 connected with the housing 28. On the side of the housing 28 located opposite the deflection pin, the clamping strip placed around the shaft 12 is connected with a clamping or arresting lever 76, which engages a cutout 78 of the housing 28 and clamps the clamping strip 72 in the course of its closing movement. It is understood that a multitude of other mechanisms for fastening the housing 28 on the shaft 12 exists, for example hooks on at least one side of the housing 28, into which the rubber clamping strips, which have been passed around the opposite side of the shaft 12, are hooked.

The evaluating device 36 operates in the master mode in order to receive, when required, the measurement data from several measuring and computer circuits 30 which, for example, are each transmitted via Bluetooth, or a suitable transmission protocol, preferably SPP or HDI, to the evaluating device 30, to store them, evaluate them and to display them. It is possible in this way for two or four players, for example, to directly compare their evaluated data with each other on a common curve diagram.

The invention claimed is:

1. A device for monitoring the accuracy with which a golf club is guided in the swing and strikes a golf ball with the striking face of its club head, comprising:

a plate-shaped sensor, which can be releasably fastened on the striking face in a defined position, by means of which the exact point of the position of the impact point in the course of striking a golf ball can be localized, the plate-shaped sensor being a touchpad, with a rectangular support plate, having a first single semiconductor layer applied to its front, which is connected along two oppositely located edge areas with a printed strip conductor connected to a signal line, and with a flexible protective plate arranged in front of the support plate, to the back of which a second single semiconductor layer has been applied and which is connected along two oppositely located edge areas with respective printed strip conductors, which are connected to a signal line and extend transversely in respect to the strip conductors connected with the first semiconductor layer, both semiconductor layers having a defined linear resistance, an electronic measuring and computing circuit, mounted together with an electrical voltage source in a housing that can be releasably fastened in a defined position on the shaft or on the back of the head of the golf club, which circuit cooperates with the plate-shaped sensor via signal lines and by means of which circuit a measuring process for determining the coordinates of the impact point in relation to the position of a predetermined reference point can be performed in the course of an impact on a golf ball, a rotation rate sensor, mounted in the housing, the sensitive axis of which sensor extends essentially parallel to the lower edge of the striking face, which sensor cooperates with the measuring and computing circuit for determining the direction of rotation, angular speed and duration of the phases of the backswing and forward swing motions of the club head, and a radio module, connected with the measuring and computing circuit, for the wireless transmission of the results of the measurements to an evaluation device in the manner of a cell phone, smart phone or PDA for the program-controlled evaluation and display of the results of the measurements on its display screen.

2. The device in accordance with claim 1, wherein the conductive layers are separated by elastic spacers, whose restoring force has been selected in such a way that there is a temporary contact between the conductive layers only when a golf ball strikes an impact point.

3. The device in accordance with claim 1, wherein the protective plate is fixedly connected in a material-to-material manner with the support plate in the edge area, except for an air inlet and outlet opening.

4. The device in accordance with claim 1, wherein the support plate is maximally 1 mm thick and is flexible.

5. The device in accordance with claim 1, wherein the active sensor face of the sensor is approximately 45 to 65 mm wide, and for putters approximately 16-20 mm high, and for clubs for pitching and chipping 20 to 30 mm high.

6. The device in accordance with claim 1, wherein the plate-shaped sensor can be releasably attached to the striking face by means of a foil, which is adhesive on both sides.

7. The device in accordance with claim 1, wherein the rotation rate sensor has one or two further sensitive axes, which extend perpendicular to a flat face enclosing the striking face and/or parallel to an axis located in the striking face and forming a right angle with the lower edge of the striking face.

8. The device in accordance with claim 1, wherein the signal lines have a disconnectable plug connection between the sensors and the measuring and computing circuit.

9. The device in accordance with claim 1, wherein the housing of the measuring and computing circuit can be fastened in a frictionally connected manner via a rubber-like contact face by means of a clamping strip.

10. A method for determining the position of the impact point of a golf ball on the striking face of a golf club by means of a device in accordance with claim 1, wherein during the time of the contact between the conductive layers at the impact point an electrical voltage is alternatingly applied between respective oppositely located edge areas of one of the conductive layers, and a voltage measurement is performed at one of the edge areas of the respective other conductive layer, and that the voltage values are converted into coordinates of the impact point by means of a proportionality factor.

11. The method in accordance with claim 10, wherein an electrical voltage is applied to one of the conductive layers only once the measurement results, ascertained in cooperation with the rotation rate sensor, are located within a certain frame and thereby signal the course of a normal backswing and forward swing motion of the club head until just before a golf ball is struck.

12. A golf club having a device in accordance with claim 1, wherein it has a mount, firmly clamped releasably in its hollow shaft and capable of being pulled out therefrom, for a weight.

* * * * *